US005104076A

United States Patent [19]

Goodall, Jr.

[11] Patent Number: 5,104,076

[45] Date of Patent: Apr. 14, 1992

[54] ARTICLE HOLDER

[76] Inventor: James M. Goodall, Jr., 2975 Maureen Ct., Loveland, Ohio 45140

[21] Appl. No.: 597,068

[22] Filed: Oct. 15, 1990

[51] Int. Cl.[5] ..... A44B 13/00

[52] U.S. Cl. ..... 248/205.2; 24/306; 224/251; 224/901; 248/309.1

[58] Field of Search ..... 248/205.2, 309.1, 311.2; 224/901, 233, 251; 24/306, 442, 16 R

[56] References Cited

U.S. PATENT DOCUMENTS

| | | | |
|---|---|---|---|
| 3,148,812 | 9/1964 | Hilsinger, Jr. | 224/251 X |
| 3,387,341 | 6/1968 | Mates et al. | 248/205.2 X |
| 3,688,348 | 9/1972 | Klotz et al. | 248/309.1 X |
| 4,341,331 | 7/1982 | McDougall | 224/901 X |
| 4,682,691 | 7/1987 | Spiering | 248/205.2 X |
| 4,712,766 | 12/1987 | Ehrenhalt | 224/901 X |
| 4,759,963 | 7/1988 | Uso, Jr. et al. | 248/205.2 X |
| 4,793,394 | 12/1988 | Cohen | 248/311.2 X |
| 4,815,172 | 3/1989 | Ward | 24/16 R |
| 4,934,646 | 6/1990 | Doyle | 248/205.2 X |
| 4,939,818 | 7/1990 | Hahn | 24/442 X |

*Primary Examiner*—Ramon O. Ramirez
*Attorney, Agent, or Firm*—Wood, Herron & Evans

[57] ABSTRACT

The present invention is directed to an easily reconfigurable and adaptable article holder comprising a flexible body having an elongated section and transverse sections extending perpendicularly outwardly from the elongated section such that the body is substantially T-shaped when in an unfolded, planar orientation. The elongated and transverse sections include cooperating means for releasably securing the article holder in a desired configuration to retain a desired article. In a preferred embodiment, the cooperating means are panels of hook and loop materials.

5 Claims, 2 Drawing Sheets

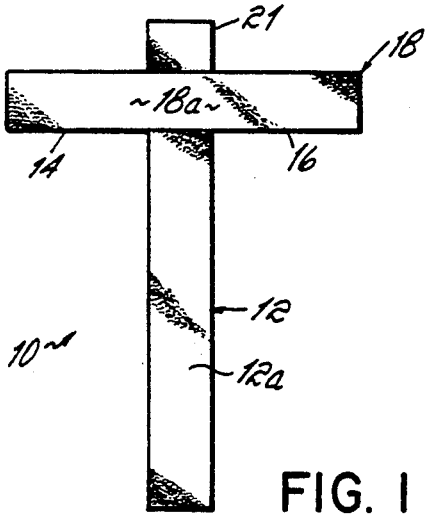
FIG. 1
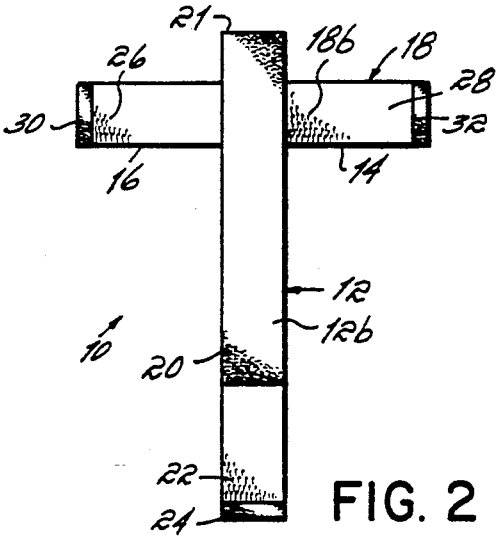
FIG. 2
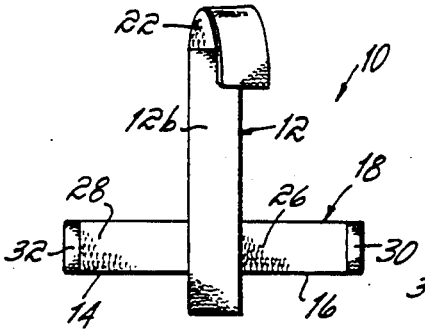
FIG. 3A
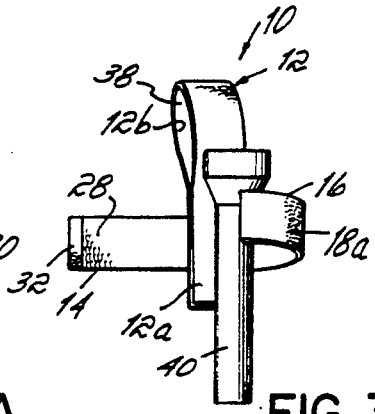
FIG. 3B
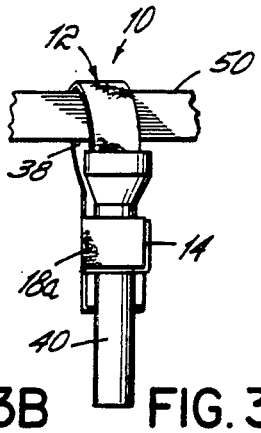
FIG. 3C
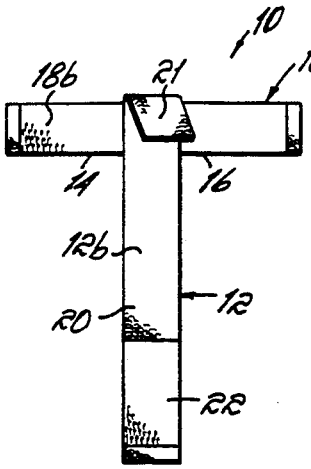
FIG. 4A
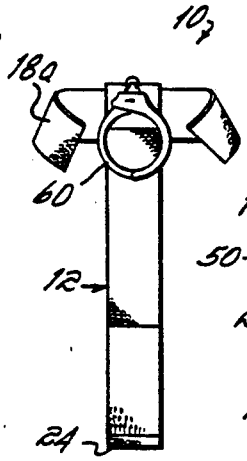
FIG. 4B
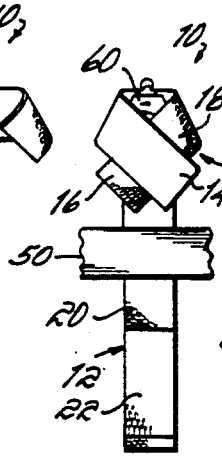
FIG. 4C
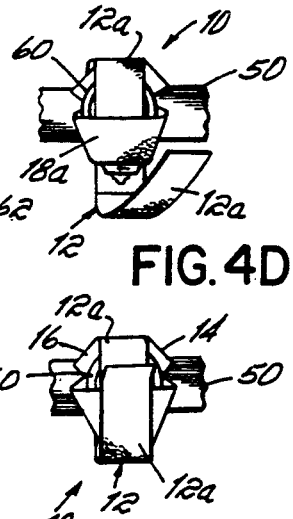
FIG. 4D
FIG. 4E

ARTICLE HOLDER

FIELD OF THE INVENTION

The present invention is directed to an article holder and more particularly to a reconfigurable article holder which is adaptable to retain any one of a wide variety of articles.

BACKGROUND OF THE INVENTION

There are numerous occupations which call for the use of hand-held articles, devices or implements that may be conveniently carried on the belt of the user. Such occupations include police and other emergency service personnel, as well as persons working in the "amber markets", which include tow truck drivers, construction workers, power and telephone line workers and others that utilize vehicles having flashing amber-colored lights.

It is known for such personnel to use specially designed belts adapted to carry a variety of articles. Belts of this nature, such as those worn by construction workers, are oftentimes cumbersome and may not provide means for carrying each specific type of device that may be needed. Other individual article holders designed for carrying a specific device are known. Article holders of this kind are limited to carrying the specific device for which they were designed, however, and are therefore of only limited usefulness.

What is needed is an article holder that is simple to construct and is easily reconfigurable and adaptable to retain any one of a wide variety of articles and that can be carried on the belt of the user thereof to provide easy access to the article.

SUMMARY OF THE INVENTION

It is an object of the present invention to provide an article holder that is adaptable to retain one of a variety of desired articles.

It is a further object of the present invention to provide an article holder that is easily reconfigurable and adaptable to retain any one of numerous different sizes and shapes of articles.

It is a further object of the present invention to provide an article holder that conforms to the shape of the desired article and retains its configuration until altered to conform to a different article.

These and other objects of the present invention are satisfied by the article holder disclosed and claimed herein. In a preferred embodiment, the article holder consists of a flexible body that has an elongated section and two transverse sections that extend perpendicularly outwardly from the elongated section. The body is substantially T-shaped when it is in an unfolded, planar orientation. The elongated section and the first and second transverse sections have cooperating means (e.g., corresponding hook and loop material panels) for releasably securing the holder in the configuration necessary to retain a desired article. Due to the design and dimensions of the article holder of the present invention, which will be described in greater detail hereinafter, the article holder is reconfigurable to retain any one of a wide variety of devices including a compact 35 mm or instant-type camera, a hand-held tape recorder, a flashlight, handcuffs, a police baton, compact binoculars, a compact radio or walkie-talkie, a scanner, a pager, a spare ammunition magazine, a speed loader, a can of mace, a stun gun, etc.

BRIEF DESCRIPTION OF THE DRAWINGS

FIG. 1 is a rear plan view of the article holder of the present invention in an unfolded, planar orientation.

FIG. 2 is a front plan view of the article holder of the invention in an unfolded, planar orientation.

FIGS. 3A–3C illustrate the sequence of steps in which the article holder of the present invention is reconfigured to retain a flashlight.

FIGS. 4A–4E illustrate the sequence of steps in which the article holder of the present invention is reconfigured to retain a pair of handcuffs.

DETAILED DESCRIPTION OF THE INVENTION

Figure 5A:
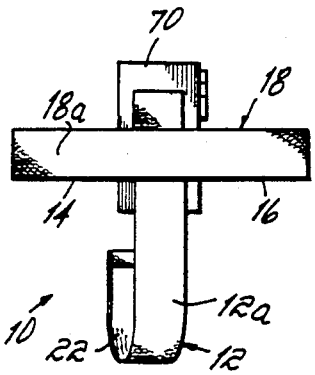
FIGS. 5A–5D illustrate the sequence of steps in which the article holder of the present invention is reconfigured to retain a compact recorder.
Figure 5B:
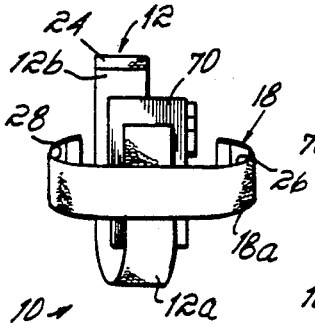
Figure 5C:
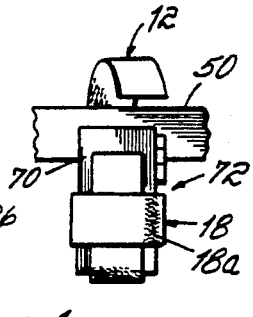
Figure 5D:
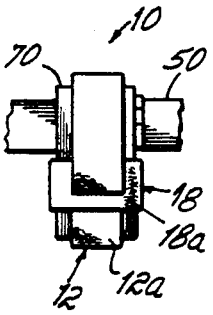

FIGS. 1 and 2 show rear and front views, respectively, of a preferred embodiment of the article holder of the present invention in an unfolded, planar orientation. Article holder 10 comprises a flexible body that includes an elongated section 12 and a cross-piece 18 such that the body is substantially T-shaped when in the unfolded, planar orientation shown. Front surface **18*b* of cross-piece 18 is preferably bonded to rear surface 12*a* of elongated section 12 with a suitable adhesive, but may be stitched or otherwise secured thereto, such that cross-piece 18 is divided into first and second transverse sections 14 and 16 when viewed from the front, as in FIG. 2. Alternatively, the transverse sections 14 and 16 can be individual pieces (not shown) stitched or otherwise secured to elongated section 12** so long as they extend substantially perpendicularly outwardly therefrom.

FIG. 1 shows the rear or "outside" surface of article holder 10 (including the rear surface **12*a* of elongated section 12 and the rear surface 18*a* of cross-piece 18) in an unfolded, generally planar orientation. This is referred to as the "outside" surface because when article holder 10 is configured to retain a desired article, this is the surface that is outwardly exposed. FIG. 2 shows the front or "inside" surface of article holder 10 (including front surface 12*b* of elongated section 12 and the front surface 18*b* of cross-piece 18) in an unfolded, planar orientation. This is referred to as the "inside" surface because when article holder 10** is configured to retain a desired article, this is the surface that is directed inwardly toward the retained article.

In a preferred embodiment of the present invention, the exposed front and rear surfaces **12*b*, 18*b* and 12*a*, 18*a*, respectively, of article holder 10 include panels of hook and loop material (as commonly sold under the trademark "Velcro") so as to releasably secure article holder 10 in a desired configuration to retain a desired article. In the embodiment shown in FIGS. 1 and 2, front surface 12*b* of elongated section 12 includes first and second panel sections 20 and 24 of loop material and third panel section 22 of hook material. Front surface 18*b* of cross-piece 18 includes first and second panels 26** and 28 of hook material and third and fourth panels 30 and 32 of loop material. In this embodiment, outside or rear surfaces 12*a* and 18*a* of elongated section 12 and crosspiece 18 preferably consist entirely of loop material.

In one preferred embodiment, the article holder of the present invention is constructed from strips of hook and loop material that are two inches in width. With reference to FIG. 2, panel section 20 is 10½" in length, panel section 22 is 4" in length, panel section 24 is ½" in length, panel sections 26 and 28 are both 4" in length, and panel sections 30 and 32 are both ½" in length. Thus, elongated section 12 is a total of 15" long and crosspiece 18 is 11" long. The above dimensions and relative positioning of the panels of hook and loop material are considered preferred for the embodiment of the present invention shown in the figures. However, it should be appreciated that other dimensions and proportions are suitable for providing an article holder falling within the spirit and scope of the present invention.

Hook and loop material is typically available in strips or sheets having the desired material (hook or loop) on one surface and a fabric backing on the other. The article holder of the present invention is easily manufactured from several strips of hook and loop material cut to the desired dimensions and bonded together—backing surface to backing surface—with a suitable adhesive, or stitched or otherwise secured together (not shown).

Having described a preferred embodiment of the structure of article holder 10, the adaptability and reconfigurability thereof will now be demonstrated and described with reference to FIGS. 3–7, showing the sequence of steps used to retain a variety of different articles with article holder 10.

FIGS. 3A–C show the sequence of steps for reconfiguring article holder 10 to retain a flashlight 40 and provide a loop for hanging the article holder and flashlight from a belt 50 of a user. As shown in FIGS. 3A and B, elongated section 12 is folded in half inwardly on top of itself and releasably retained in that position by the cooperation between hook panel 2 and loop panel 20. Folding section 12 in half as shown provides a loop 38 through which a belt 50 may be received to suspend the article holder and device retained therein. Flashlight 40 is placed against the folded-over section at the location of the intersection of panels 12 and 18 and transverse panels 14 and 16 are folded inwardly therearound, as shown. Article holder 10 is retained in the configuration shown by the cooperation of either hook panel 26 or 28 with the outside surface 18*a* of section 18, which is loop material. Thus, as shown in FIG. 3C, flashlight 40 is retained by article holder 10 and the entire assembly is suspended from belt 50.

FIGS. 4A–E shows the sequence of steps in which article holder 10 is reconfigured to retain a pair of handcuffs 60 and suspended from a belt 50. As shown in FIGS. 4A and B, distal end 21 of panel 20 is folded inwardly against itself and handcuffs 60 are placed at the location of the intersection of section 12 and section 18 (FIG. 4B). Transverse sections 14 and 16 are then folded inwardly across handcuffs 60 forming a crisscross and covering the handcuffs. The opposite end of section 12 is then slid under belt 50 and the "cradle" 62 formed around handcuffs 60 is folded downwardly so as to suspend the assembly from belt 50. Finally, hook panel 22 of section 12 is folded upwardly and cooperates with the exposed loop material of section 18*a* to retain handcuffs 60 in cradle 62 and hanging the assembly from belt 50 (as shown in FIGS. 4C–E).

FIGS. 5A–D show the steps in the sequence used to reconfigure article holder 10 to retain a tape recorder 70 and for hanging the assembly from a belt 50. As shown in FIGS. 5A and B, tape recorder 70 is placed at the location of the intersection of sections 12 and 18, on the inside surface thereof. Section 12 if folded upwardly and inwardly about recorder 70 and transverse sections 14 and 16 are folded inwardly therearound to form a cradle 72 therefor, with one of hook panels 26 or 28 cooperating with rear surface 12*a* (loop material) of section 12 to retain the recorder. Finally, panel section 22 of section 12 is slid under belt 50 and folded over and downwardly to close article holder 10 around recorder 70 and suspend the entire assembly from belt 50. Panel section 22 (hook material) cooperates with rear surface 18*a* (loop material) of section 18 to releasably "close" the article holder and retain the recorder.

Figure 6A:
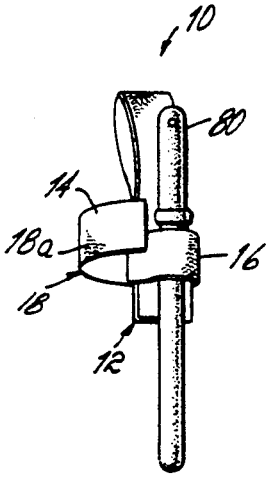
FIGS. 6A and B illustrate two of the sequence of steps in which the article holder of the present invention is reconfigured to retain a police baton.
Figure 6B:
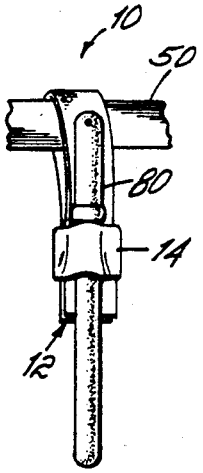
Figure 7:
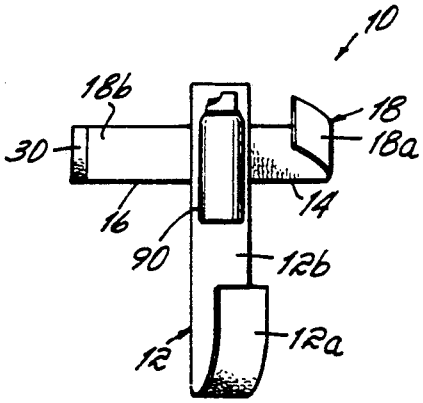
FIG. 7 shows the article holder of the present invention in an orientation prior to reconfiguration to retain a can of mace.

FIGS. 6A and B show article holder 10 retaining a police baton 80; the steps for this reconfiguration are substantially the same as those for the flashlight shown in FIGS. 3A–C. Finally, FIG. 7 shows the article holder of the present invention in a partially unfolded position with a can of spray mace 90 set in place to be retained following the same sequence of steps used to retain tape recorder 70.

It will be appreciated that the article holder of the present invention is easily adaptable and reconfigurable to retain a wide variety of articles in addition to those specifically disclosed and described herein.

What is claimed is:

1. An article holder reconfigurable and adaptable to releasably retain one of a variety of articles, comprising:

a flexible body comprising an elongated section having first and second ends and first and second transverse sections extending perpendicularly outwardly from said elongated section nearer said first end than said second end of said elongated section, said body being substantially T-shaped when in an unfolded, planar orientation, said elongated section having a first surface comprising loop material and a second surface comprising a first panel of loop material extending from said first end of said elongated section at least one-half the length of said elongated section, a second panel of loop material extending from said second end of said elongated section, said second panel of loop material being substantially shorter than said first panel of loop material, and a panel of hook material disposed between said first and second panels of loop material, said first and second transverse sections each having a first surface comprising only loop material, said transverse sections each having a distal end and a second surface comprising a panel of hook material adjacent said elongated section and extending outwardly therefrom a substantial portion of the length of said transverse section, and a panel of loop material adjacent said panel of hook material and extending to said distal end of said transverse section, wherein said panels of hook and loop material cooperate to releasably secure said holder in a desired configuration to retain a desired article, said elongated section serving the functions of forming a cradle for the article retained therein, providing a closure for said cradle and acting as a hanger for suspending said holder and article retained therein.

2. The article holder of claim 1 constructed of strips of hook and loop material having a width of 2".

3. The article holder of claim 2 wherein said elongated section is 15" in length and each of said transverse sections is 4½" in length.

4. The article holder of claim 3 wherein said panel of hook material of each said transverse section is 4" in length and said panel of loop material of each said transverse section is ½" in length.

5. The article holder of claim 4 wherein said first panel of loop material of said elongated section is 10½" in length, said second panel of loop material is ½" in length, and said panel of hook material is 4" in length.

* * * * *